US009679461B2

(12) United States Patent
Cummings et al.

(10) Patent No.: US 9,679,461 B2
(45) Date of Patent: Jun. 13, 2017

(54) SAFETY DEVICE

(71) Applicant: BLUESKY SOLUTIONS LIMITED, Lutterworth (GB)

(72) Inventors: Paul Cummings, Souldern (GB); Kevin Jonathan Gale, Marlow (GB)

(73) Assignee: BLUESKY SOLUTIONS LIMITED, Lutterworth (GB)

( * ) Notice: Subject to any disclaimer, the term of this patent is extended or adjusted under 35 U.S.C. 154(b) by 0 days.

(21) Appl. No.: 14/872,579

(22) Filed: Oct. 1, 2015

(65) Prior Publication Data

US 2016/0098910 A1 Apr. 7, 2016

(30) Foreign Application Priority Data

Oct. 2, 2014 (GB) ..... 1417426.2

(51) Int. Cl.

| | |
|---|---|
| ***G08B 21/00*** | (2006.01) |
| ***G08B 21/02*** | (2006.01) |
| ***B66F 11/04*** | (2006.01) |
| ***B66F 17/00*** | (2006.01) |
| *E04G 1/22* | (2006.01) |
| *A47L 3/04* | (2006.01) |
| *E06C 5/34* | (2006.01) |

(52) U.S. Cl.
CPC ..... *G08B 21/02* (2013.01); *B66F 11/042* (2013.01); *B66F 17/006* (2013.01)

(58) Field of Classification Search
CPC ..... B66F 17/006; B66F 11/046; G08B 21/18
USPC ..... 340/685; 182/148, 18, 3
See application file for complete search history.

(56) References Cited

U.S. PATENT DOCUMENTS

| | | | | |
|---|---|---|---|---|
| 4,979,588 | A * | 12/1990 | Pike | B66F 11/046 182/18 |
| 6,405,114 | B1 * | 6/2002 | Priestley | B66F 11/046 182/18 |
| 6,595,330 | B1 | 7/2003 | Henrickson et al. | |
| 9,193,573 | B1 | 11/2015 | Troy | |
| 2003/0174064 | A1 * | 9/2003 | Igarashi | B66F 17/006 340/685 |
| 2005/0187712 | A1 * | 8/2005 | Callaghan | B66B 5/0031 701/301 |
| 2007/0084450 | A1 | 4/2007 | Oka et al. | |
| 2009/0260920 | A1 | 10/2009 | Cummings | |

(Continued)

FOREIGN PATENT DOCUMENTS

| | | |
|---|---|---|
| CN | 102120556 | 7/2011 |
| CN | 202030492 U | 11/2011 |

(Continued)

OTHER PUBLICATIONS

United Kingdom Search Report for British Patent Application No. GB1417421.3, issued Mar. 18, 2015, 3 pages.

(Continued)

*Primary Examiner* — Jack K Wang
(74) *Attorney, Agent, or Firm* — Foley & Lardner LLP

(57) ABSTRACT

A pre-crush sensor module for use with a safety device for an aerial lift having a basket or cage. The pre-crush sensor module having removably attachable sensor which provide a detection zone wherein the sensors detect obstacles. The sensor module also having an operator warning system and a relay to connect the sensors to the safety device.

14 Claims, 7 Drawing Sheets

(56) References Cited

U.S. PATENT DOCUMENTS

| | | | | |
|---|---|---|---|---|
| 2010/0133043 | A1* | 6/2010 | Black | B66F 11/044 182/148 |
| 2012/0160604 | A1* | 6/2012 | Bowden | B66F 11/044 182/18 |
| 2013/0153333 | A1* | 6/2013 | Richards | B66F 11/044 182/18 |
| 2013/0233645 | A1* | 9/2013 | Hao | B66F 17/006 182/19 |
| 2014/0021912 | A1 | 1/2014 | Martin et al. | |
| 2015/0008073 | A1* | 1/2015 | Cummings | B66F 11/04 182/148 |

FOREIGN PATENT DOCUMENTS

| | | |
|---|---|---|
| EP | 1 026 120 | 8/2000 |
| EP | 2 096 078 | 9/2009 |
| FR | 2836468 | 10/2004 |
| GB | 2 481 709 | 1/2012 |
| GB | 2 495 158 | 4/2013 |
| JP | 2011-063352 | 3/2011 |
| JP | 2013-010589 | 1/2013 |
| WO | WO-2012/001353 | 1/2012 |
| WO | WO2013/093395 | 6/2013 |

OTHER PUBLICATIONS

United Kingdom Search Report for British Patent Application No. GB 1417426.2, issued Mar. 18, 2015, 4 pages.
U.S. Appl. No. 14/872,593, filed Oct. 1, 2015, Cummings, Paul.
International Search Report and Written Opinion for PCT/GB2015/052856, issued Feb. 2, 2016, 13 pages.

* cited by examiner

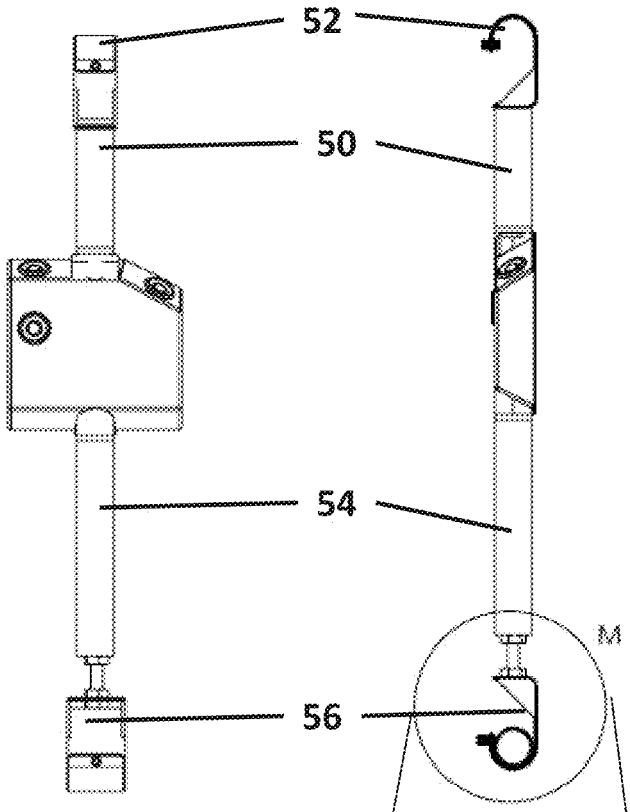
FIGURE 5A
FIGURE 5B
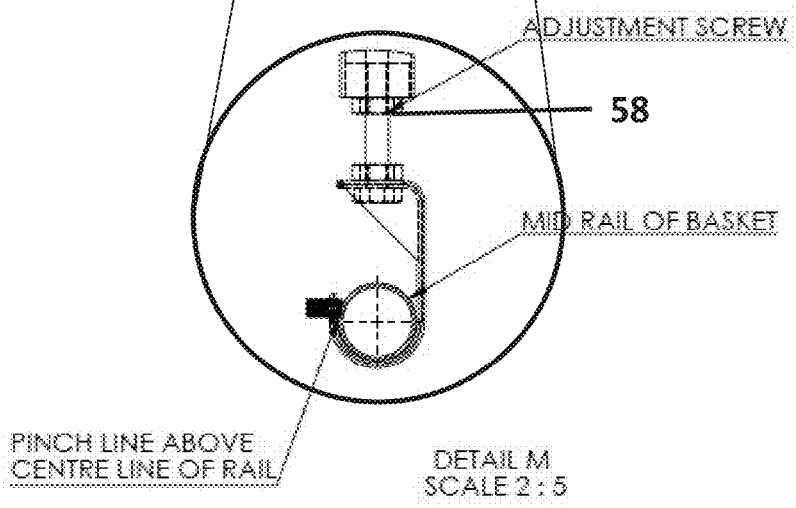

SAFETY DEVICE

CROSS-REFERENCE TO RELATED APPLICATIONS

This application claims priority to United Kingdom Patent Application No. GB1417426.2, filed Oct. 2, 2014, the contents of which are hereby incorporated by reference in its entirety

FIELD OF THE INVENTION

The present disclosure relates to a safety device for aerial lifts and an aerial lift comprising the same.

BACKGROUND TO THE INVENTION

Aerial lifts are frequently employed for lifting operatives to elevated working sites, for example to install overhead pipe work during building construction. A typical aerial lift may comprise a mobile elevated work platform (MEWP) having an extendable boom which has an elevator basket or cage for housing operatives securely to the end of the boom. Alternative aerial lifts may comprise a MEWP having an extendable scissor lift which has an elevator basket or cage for housing operatives securely to the end of the scissor lift.

The basket or cage generally contains a control panel which permits an operative standing in the basket or cage to manoeuvre the work platform as desired. The aerial lift may be powered using hydraulics powered by the MEWP's engine.

The control panel generally features an emergency stop switch and a safety switch which needs to be operated before the controls can be operated. In boom lifts the safety switch is typically a footswitch which must be depressed to activate the controls. In scissor lifts the safety is typically a dead man's handle. If the safety switch is release, the basket of cage is prevented from moving immediately but the MEWP's engine (which powers the hydraulics) continues to run. If the emergency stop switch is activated then both the basket is prevented from moving and the MEWP's engine is stopped.

Unfortunately it is known that operators can become trapped between the basket and an obstacle before they can either release the safety switch or activate the emergency stop. This is known as an entrapment event. Accidents of this nature can be fatal.

The present applicants have previously described a safety device designed to limit the damage caused by entrapment events by detecting such an event after it happens and preventing further movement of the basket or cage. The safety devices comprise either a tensioned cord or wire (EP2096078B1) or an a pressure sensitive safety edge (WO2012/001353). Activation of the safety device, which is located proximate to the control panel, prevents movement of the basket or cage by overriding the safety switch.

The present inventors have identified that it is preferable to prevent an entrapment even before it occurs rather than after it happens. Therefore it is an objective of the present disclosure to provide a pre-crush module that can prevent entrapment events before they happen.

SUMMARY OF THE INVENTION

According to a first aspect there is provided a pre-crush sensor module for use with a safety device for an aerial lift having a basket or cage, the pre-crush sensor module comprising a plurality of sensors that are removably attachable to the basket or cage, the sensors providing a detection zone wherein the sensors detect obstacles within the detection zone that may potentially strike an operator standing in the basket or cage before the strike occurs, an operator warning system, and a relay to connect the sensors to the safety device to activate the safety device to: alert the operator to the presence of the obstacle, and prevent further movement of the basket or cage.

Advantageously, the pre-crush sensor module alerts the operator of the aerial lift to the presence of an obstacle before it can hit him, thereby avoiding an entrapment event. Further beneficially, the module can be plugged into existing safety devices to work synergistically with anti-entrapment safety devices giving an additional level of safety to the operator.

In a second aspect of the invention there is provided an aerial lift comprising a safety device and a pre-crush module according to the present disclosure.

In a third aspect of the invention there is provided a method of preventing an obstacle striking an operator standing in a basket or cage of an aerial lift comprising the steps:

- installing a plurality of sensors to the basket or cage to establish a detection zone,
- connecting the sensors to a safety device capable of preventing movement of the basket or cage and/or alerting the operator to the presence of an obstacle,
- monitoring the detection zone for an obstacle entering the detection zone,
- sending a signal from the sensors to the safety device to instruct the safety device to alert the operator and/or to prevent movement of the basket or cage.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIG. 5A shows a sensor housing along with supporting clamps used to fasten housing to basket or cage.

FIG. 5B shows a side view of the sensor housing of FIG. 5A and a close up of the supporting clamp around the rail of the basket or cage. The supporting clamp is flush with the rail.

DETAILED DESCRIPTION

There will now be described, by way of example, a specific mode contemplated by the inventors. In the following description numerous specific details are set forth in order to provide a thorough understanding. It will be apparent however, to one skilled in the art, that the present invention may be practiced without limitation to these specific details.

Figure 1A:
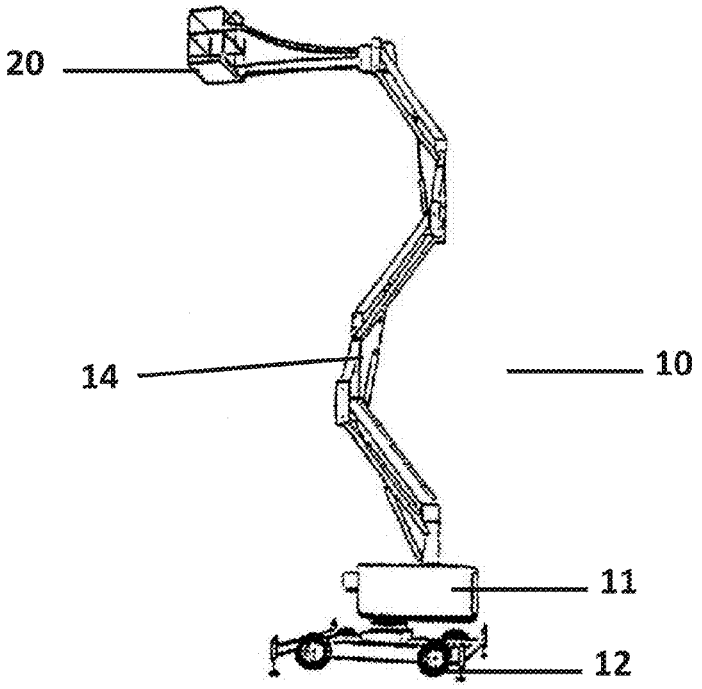
FIG. 1A shows a MEWP with an extendable boom.
Figure 1B:
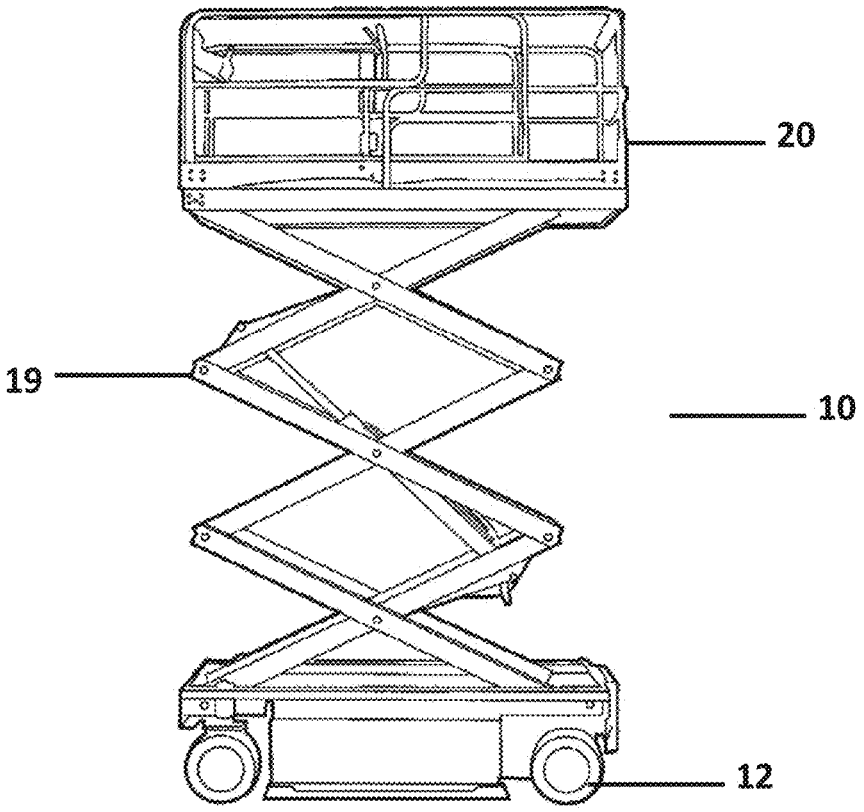
FIG. 1B shows a MEWP with a scissor lift.

FIGS. 1A and 1B

With reference to FIG. 1A, there is shown a mobile elevated work platform (MEWP) 10 in the form of a self drive mobile lift of any suitable type. The MEWP 10 has a drivable vehicle body 11 having wheels 12 and an extendable boom 14 mounted on a load carrying platform 13 at the rear of the vehicle body 11. Stabilisers 15 may be provided for steadying the vehicle on the ground G. A basket 20 or cage is mounted on the free end of the boom 14 and the basket 20, in use, can be raised or lowered and generally maneuvered relative to the ground G as is well known. The basket 20 is shown in a raised condition. The boom 14 is raised, lowered, extended, rotated etc. by any suitable means, typically operated by a powered hydraulic system provided on the vehicle body 11 and powered by the vehicle engine. The boom 14 may be provided with a load sensor 18 which senses the total load on the boom 14.

With reference to FIG. 1B, there is shown a MEWP 10 in the form of a scissor lift, having wheels 12, an extendable scissor lift 19 and a basket of cage 20 mounted on the free end of the scissor lift. In use, the basket or cage can be raised or lowered relative to the ground.

Figure 2A:
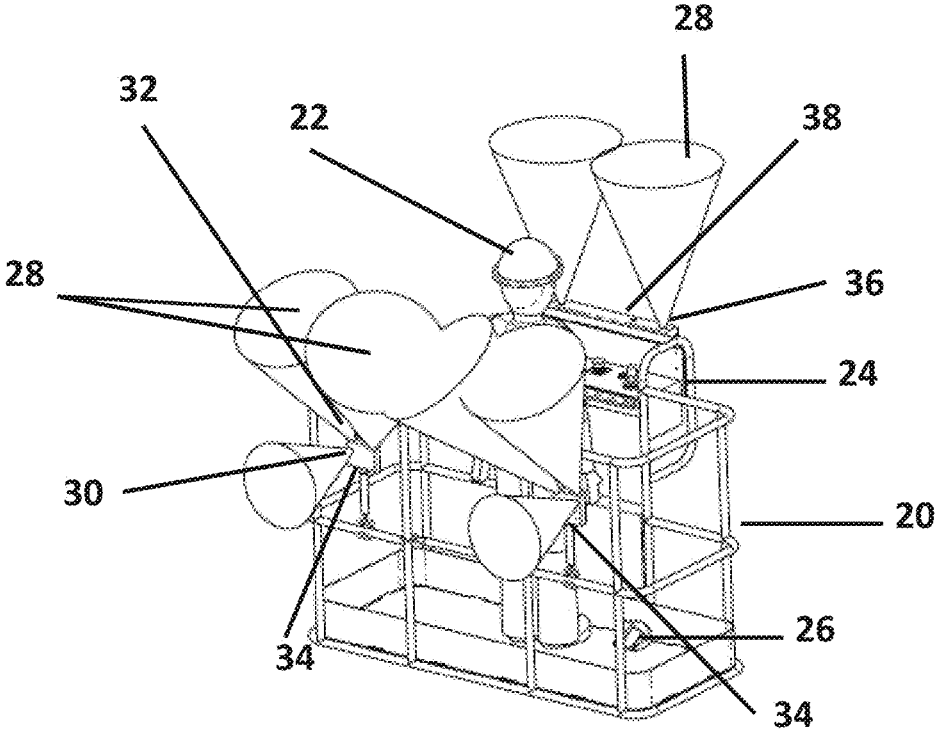
FIG. 2A shows an isometric view of a basket or cage having a pre-crush sensor module and also highlighting, schematically, the detection zone provided by each sensor.
Figure 2B:
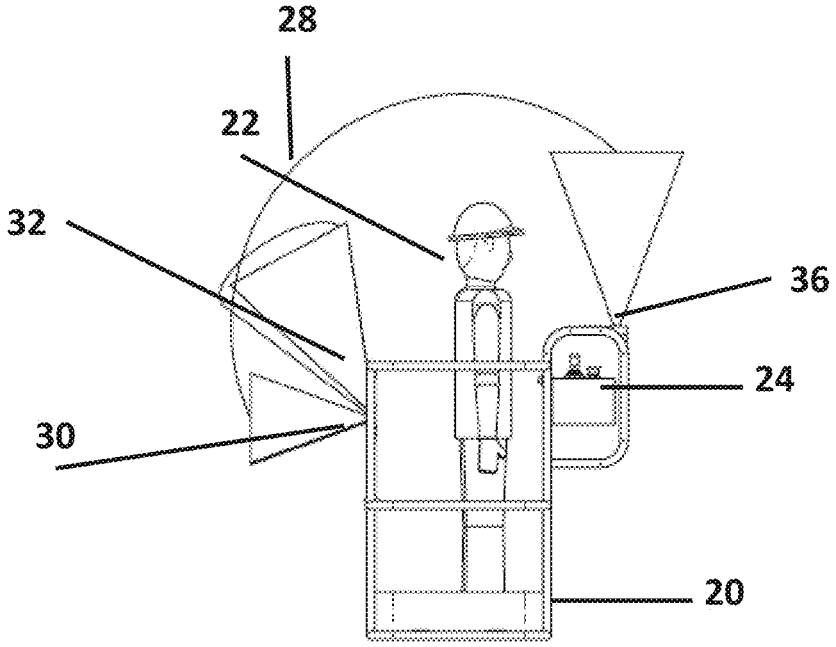
FIG. 2B shows a side view of the basket or cage of FIG. 2A, highlighting the detection zone above the operator's head.

FIGS. 2A and 2B

With reference to FIGS. 2A and 2B there is shown a basket or cage 20 with an operator 22 stood therein in front of a control panel 24. The detection zone 28 is indicated generally, the detection zone being created by two upward facing sensors 36 mounted on the control panel 24, two rearward facing sensors 30 mounted on the back of the basket or cage and four angled-rearward facing sensors also mounted on the back of the basket or cage. The rearward and angled-rearward facing sensors are housed in a sensor housing 34 which the upward facing sensors are housed in a control panel sensor housing. Also shown is a footswitch 26 which can be used to override the pre-crush sensor module.

The sensors each detect a conical shaped area which is larger the further away from the sensor the obstacle is up to the limit of the sensor. Overlap in these cones creates the detection zone.

Figure 3A:
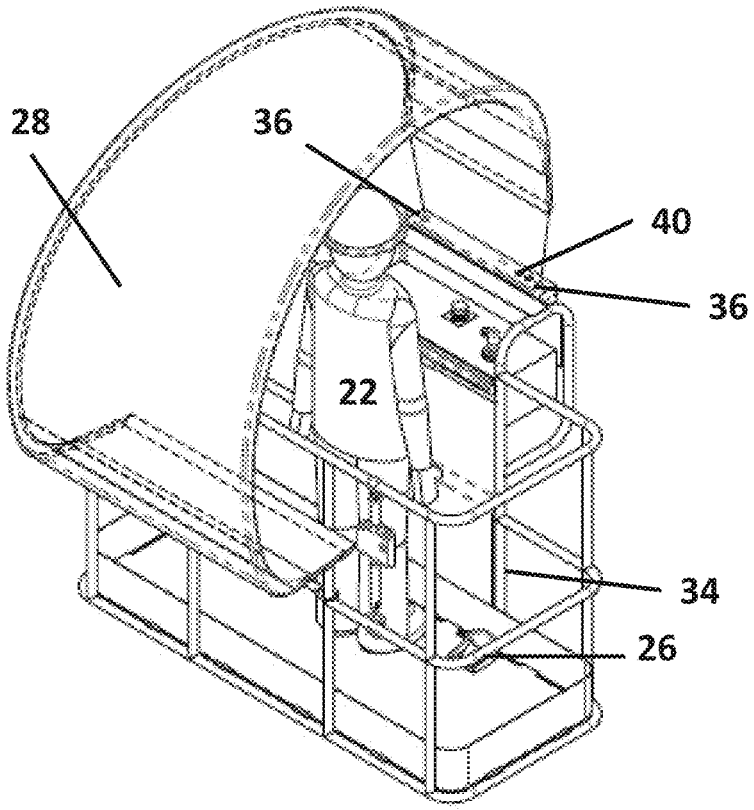
FIG. 3A shows an isometric view of a basket or cage having a pre-crush sensor module, highlighting, schematically, the detection zone and also showing the warning lights.
Figure 3B:
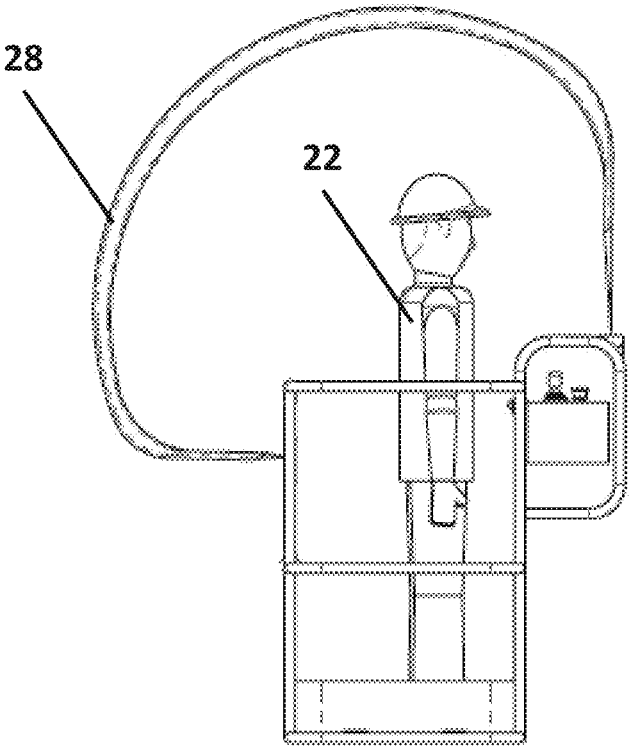
FIG. 3B shows a side view of the basket or cage of FIG. 3A, highlighting the detection zone above the operator's head.

FIGS. 3A and 3B

With reference to FIGS. 3A and 3B there is shown a different representation of the detection zone wherein the detection zone can be referred to as a "Mohican zone". This term refers to the fact that the detection zone is not a spherical bubble around the operator, the sides of the basket or cage are not within the detection zone.

The upward facing sensors 36 are shown housed in a control panel sensor housing which also features warning lights 40 of the operator warning system.

FIG. 4

Figure 4:
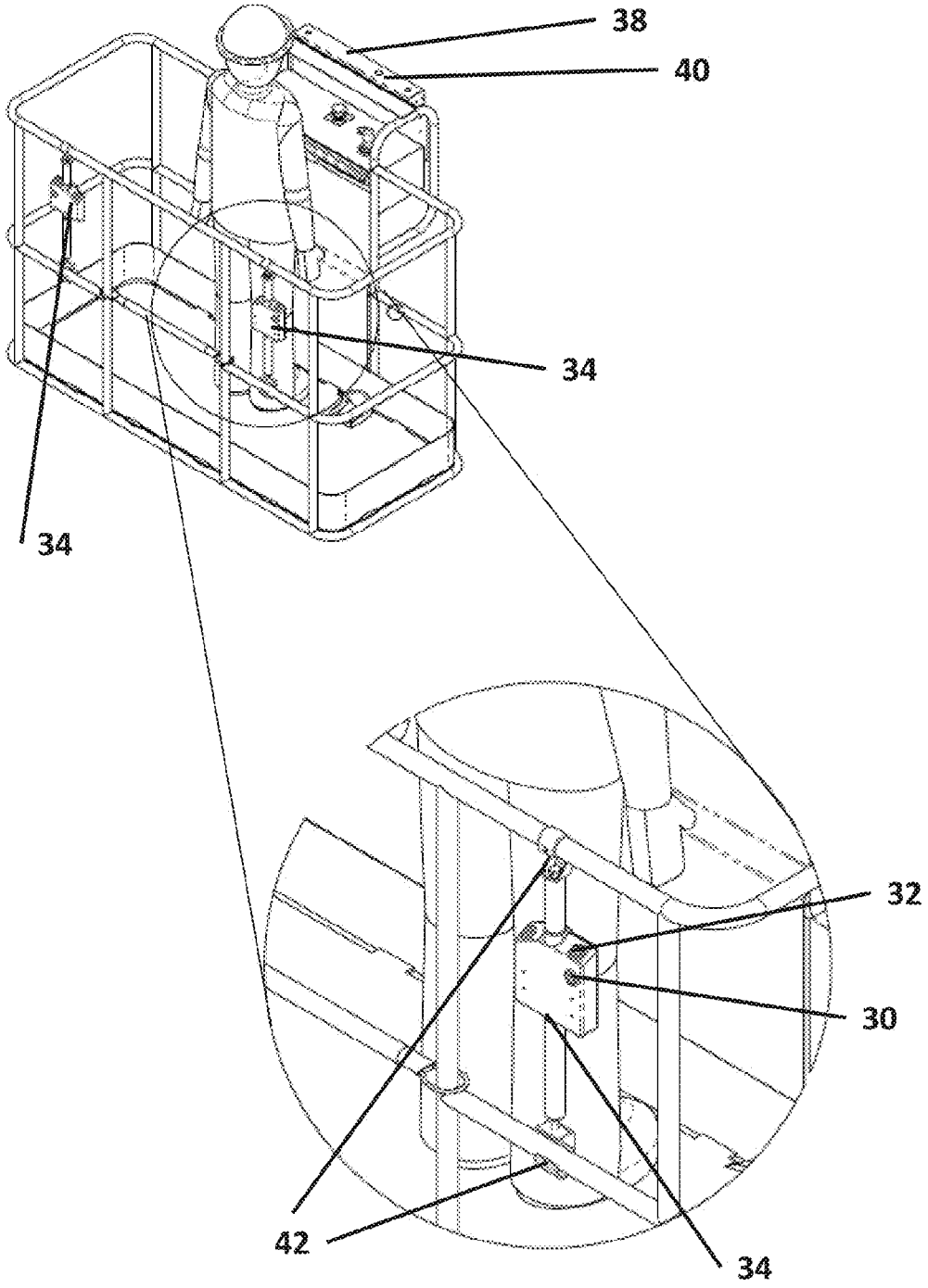
FIG. 4 shows a close up of the sensor housing comprising the rearward and angled-rearward sensors.

With reference to FIG. 4 there is shown the upward facing sensors housed in a control panel sensor housing 38 and the rearward facing and angled-rearward facing sensors housed in sensor housings 34 at a spaced apart location.

A close up of the sensor housing 34 is shown indicating that the sensor housing houses two angled-rearward facing sensors 32 and one rearward facing sensor 30. Also shown are clamps 42 that allow the sensors to be removably attachable to the basket or cage.

The housing and the clamps are arranged such that they do not protrude either into or out of the basket or cage.

FIGS. 5A and 5B

With reference to FIGS. 5A and 5B there is shown a front and side view of the sensor housings of FIG. 4, also showing the attachment means. The attachment means comprise and upper arm 50 and upper clamp 52 which attach to the upper rail of the basket or cage and a lower arm 54 and lower clamp 56 which attach to the mid rail of the basket or cage. The lower arm has an adjustment screw which enables the sensor housing to be held securely in place by permitting the arm to be lengthened and shortened to make it fit snugly to the mid rail such that the clamps are substantially flush with each respective rail.

Figure 6A:
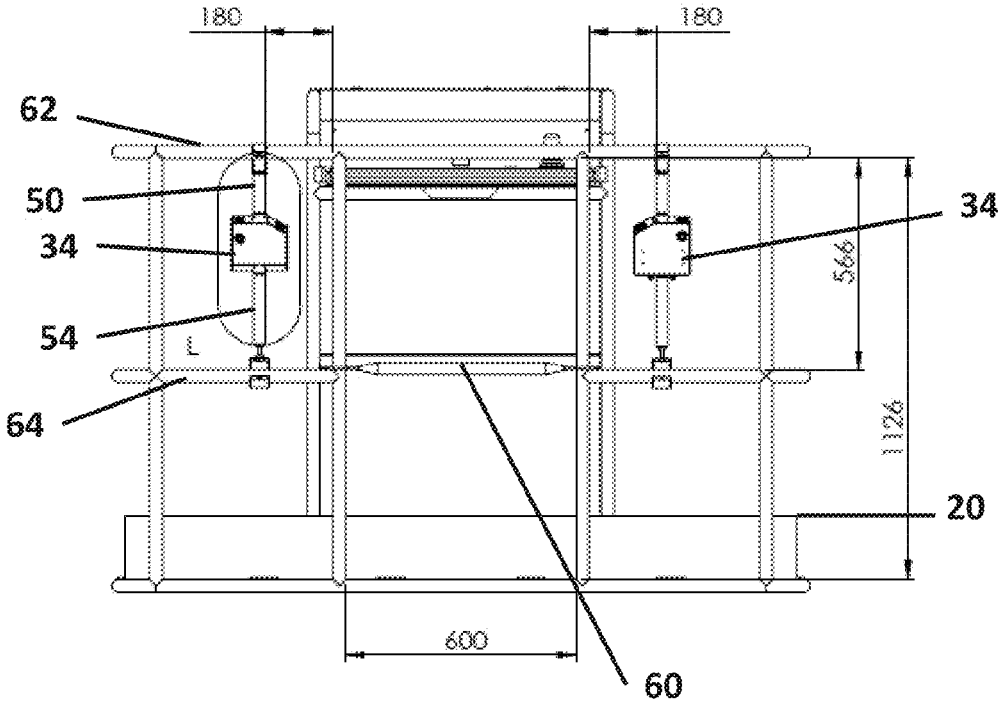
FIG. 6A shows the sensor housings in situ along side the entrance gate also showing dimensions.
Figure 6B:
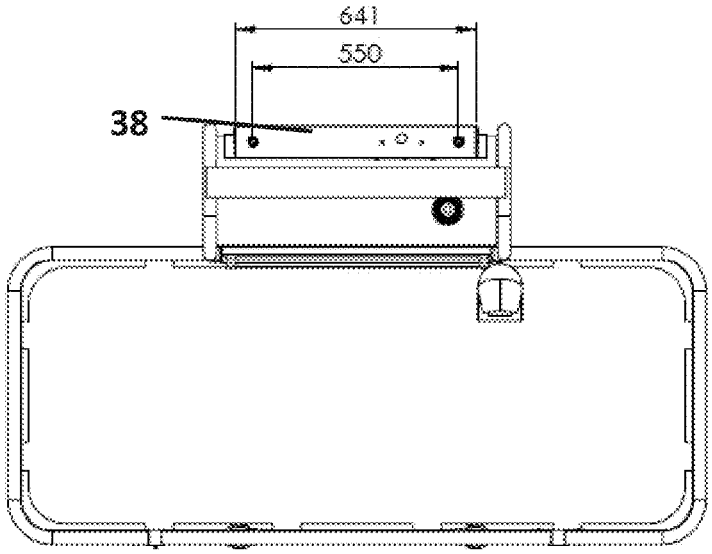
FIG. 6B shows the control panel sensor housing along with dimensions.

FIGS. 6A and 6B

With reference to FIG. 6A there is shown a rear view of the basket or cage 20 showing spaced apart sensor housings 34 with upper 50 and lower arms 54 to each side of the basket entrance gate 60. The sensor housings are attached to the upper rail 62 and the mid rail 64 of the basket or cage at a position approximately 180 mm to either side of the entrance gate. The gate is shown as a standard 600 mm width gate.

FIG. 6B shows an overhead of the basket or cage showing the control panel sensor housing 38 and dimensions thereof.

Figure 7A:
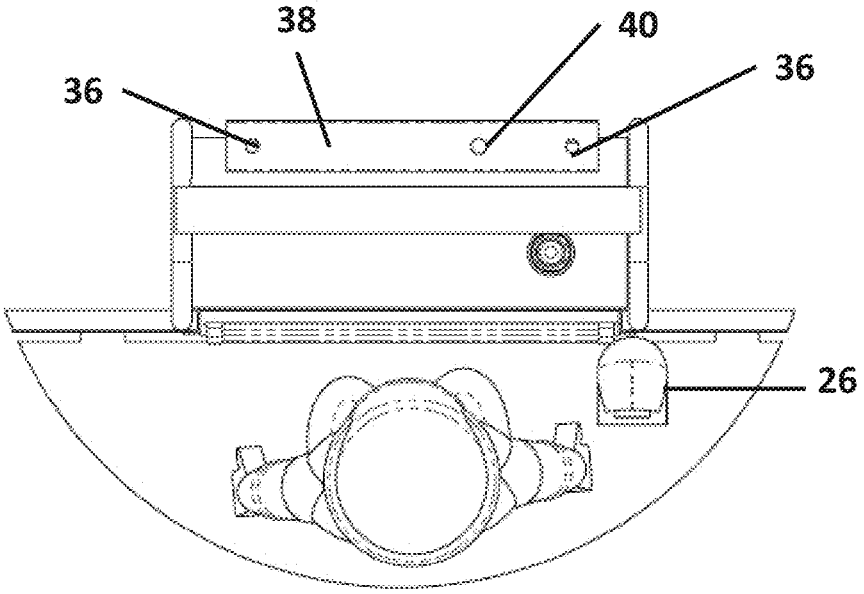
FIG. 7A shows an overhead view of the control panel showing the control panel sensor housing with an operator in situ.
Figure 7B:
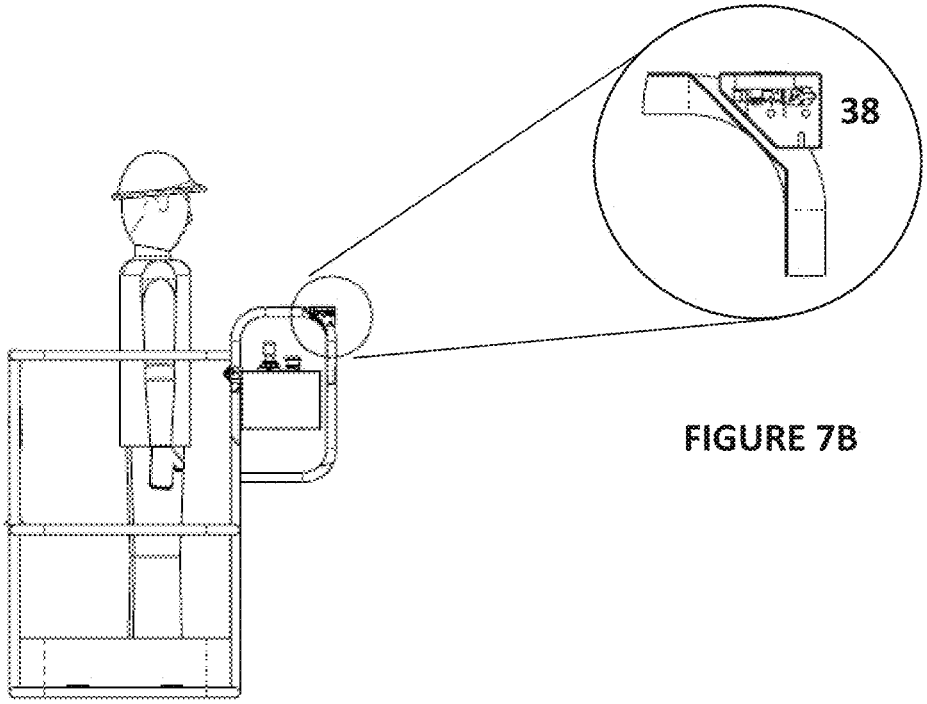
FIG. 7B shows a side view of FIG. 5A and a close up the control panel sensor housing.

FIGS. 7A and 7B

With reference to FIGS. 7A and 7B there is shown a top down view of an operator standing in front of the control panel of an aerial lift. FIG. 7A shows upward facing sensors 36 mounted in a control panel sensor housing which also features warning lights 40.

FIG. 7B shows a close up of the control panel sensor housing which is arranged such that it does not protrude either into or out of the basket or cage. It sits within the limits of the control panel protection bars.

In the context of the present disclosure, pre-crush sensor module means a module that can be connected to a safety device to enhance the abilities of the safety device such that entrapment events are detected before they occur. Advantageously, this reduces the likelihood of crush injuries to operators of aerial lifts, particularly when maneuvering to overhead obstacles and particularly when the basket or cage is being moved backwards. Typically the operator must face the control panel when maneuvering so he cannot be alert to what is behind him.

In one embodiment the pre-crush sensor module is an anti-entrapment device.

In one embodiment the pre-crush sensor module is not an anti-collision device. Anti collision devices prevent collisions between obstacles and the basket or cage, typically to prevent damage to expensive obstacle, not between obstacles and operators.

In one or more embodiments the pre-crush sensor module may comprise sensors that detect obstacles outside of the basket. In such embodiments the pre-crush sensor module functions as an anti-collision device.

As employed herein safety device means a device for preventing or limiting the severity of entrapment events. That is, an accident in which an operator is struck by an object causing him to be pressed against the switch activation device in a potential crushing position. Such safety devices are known in the art, for example see WO2012/001353 which is incorporated herein by reference.

As employed herein aerial lift refers to any form of powered extendable lift for enabling an operative to work at height, such as a MEWP, cherry picker or scissor lift. Aerial lift does not include a forklift truck or manually-powered (i.e. non-electrical) lifts.

Basket or cage as employed herein refers to a working platform with a safety barrier. The basket or cage is typically not enclosed overhead.

Sensors as employed herein means a device that detects a change in events. In the present context the event to be detected is the presence of an obstacle. Suitable sensors such as proximity sensors including, but are not limited torn Doppler radar, passive infrared, motion detectors, capacitive, capacitive displacement, eddy-current, inductive, laser rangefinder, light beam or curtain, magnetic, passive optical, passive thermal infrared, photocell, Doppler effect, radar, reflection of ionising radiation, sonar and ultrasonic sensors.

The maximum distance that a sensor can detect is defined "nominal range". Some sensors have adjustments of the nominal range or means to report a graduated detection distance.

Hysteresis is a term relating to sensors which indicates the sensor's response to objects that are getting closer as opposed to those which are moving away from the sensor. In one embodiment hysteresis is set to approximately 1 to 15 cm increments, such as 2, 3, 4, 5, 6, 7, 8, 9, 10, 11, 12, 13, or 14 cm, for example approximately 5 cm increments. That is, a detected obstacle 100 cm away will be detected at 95 cm away, 90 cm away etc when moving toward it and will also be detected up to 105 cm away when moving away from it.

De-bounce is a term relating to sensors which indicates the number of signals detected by the sensor before an event output is passed on. In one embodiment the sensors detect obstacles approximately every 20 to 60 ms (milliseconds), such as 25, 30, 35, 40 45, 50 or 55 ms. For example every 40 ms. In one embodiment the debounce can detect obstacles in 1 to 15 consecutive detections, such as 2, 3, 4, 5, 6, 7, 8, 9, 10, 11, 12, 13, or 14 detections. For example 2 consecutive detections. In one embodiment the safety device is activated following two consecutive detection signals from a single sensor.

Advantageously proximity sensors typically have a high reliability and long functional life because of the absence of mechanical parts and lack of physical contact between sensor and the sensed object.

In one embodiment the sensors are ultrasonic sensors.

Ultrasonic as employed herein means sound at a frequency above the audible limit of human hearing, that is, above 20,000 Hz.

In one embodiment the ultrasonic sensors have a frequency of 39 to 41 kHz.

In one embodiment the sensors will have a detection angle of approximately 30 to 50 degrees, such as 31, 32, 33, 34, 35, 36, 37, 38, 39, 40, 41, 42, 43, 44, 45, 46, 47, 48 or 49 degrees. For example approximately 40 degrees.

In one embodiment the sensors have a conical detection area. That is, a narrower detection area closer to the sensor and a wider detection area further away from the sensor.

In one embodiment the sensors detect obstacles up to approximately 100 cm away, such as 70, 71, 72, 73, 74, 75, 76, 77, 78, 79, 80, 81, 82, 83, 84, 85, 86, 87, 88, 89, 90, 91, 92, 93, 94, 95, 96, 97, 98 or 99 cm away. For example approximately 80 cm (800 mm) or 90 cm (900 mm) or 100 cm (1000 mm) away. For example the upward facing sensor detects obstacles up to 80 cm away. For example the angles rearward facing sensors detect obstacles up to 100 cm away.

In one embodiment the rearward facing sensors detect obstacles approximately 30 to 50 cm away, such as 31, 32, 33, 34, 35, 36, 37, 38, 39, 40, 41, 42, 43, 44, 45, 46, 47, 48, 49 or 50 cm away, for example approximately 40 cm (400 mm) away.

In one embodiment the conical detection area has a diameter of approximately 550 to 600 mm at 800 mm away, such as 555, 560, 565, 570, 575, 580, 585, 590 or 595 mm. For example approximately 582 mm at 800 mm away.

In one embodiment the conical detection area has a diameter of approximately 625 to 675 mm at 900 mm away, such as 630, 635, 640, 645, 650, 655, 660, 665 or 670 mm. For example approximately 655 mm at 900 mm away.

In one embodiment the conical detection area has a diameter of approximately 700 to 750 mm at 1000 mm away, such as 705, 710, 715, 720, 725, 730, 735, 740 or 745 mm. For example approximately 728 mm at 1000 mm away.

In one embodiment the conical detection area has a diameter of approximately 250 to 300 mm at 400 mm away, such as 255, 260, 265, 270, 275, 280, 285, 290 or 295 mm. For example approximately 291 mm at 400 mm away.

In one embodiment the conical detection area of two or more sensors overlaps.

In one embodiment the sensors are housed in a sensor housing.

Housed as employed herein means a container wherein the sensors can be situated to protect them from the outside environment whilst still permitting them to function.

Sensor housing as employed herein means a housing for one or more sensors, for example 2, 3, 4, 5 or 6 sensors.

Typically, a sensor housing will also feature an indicator light for each sensor arranged to indicate whether the sensor is functional and optionally whether the sensor has detected an obstacle.

Typically at least 2 sensors are employed in the pre-crush sensor module, such as 3, 4, 5, 6, 7, 8, 9, 10, 11, 12, 13, 14, 15 or 16 sensors.

In one embodiment the pre-crush sensor module comprises 8 sensors.

In one embodiment the 8 sensors are positioned in the following positions:

two upward facing sensors are mounted on a control panel of the aerial lift, two rearward facing sensors are mounted on a back of the basket or cage four angled-rearward facing sensors are mounted on the back of the basket or cage.

In one embodiment the angled-rearward facing sensors are substantially vertical, that is, they are upward facing.

In one embodiment the angled-rearward facing sensors are angled about 20 to 50 degrees from vertical, such as 25, 30, 35, 40 or 45 degrees from vertical. For example approximately 30 degrees from vertical.

In one embodiment the angled-rearward facing sensors are rotated about 20 to 50 degrees from plane of the sensor housing, such as 25, 30, 35, 40 or 45 degrees from plane of the sensor housing. For example approximately 30 degrees from the plane of the sensor housing. That is, the sensor is directed slightly behind the basket or cage.

In one embodiment one or more sensors are upward facing sensors.

Upward facing as employed herein means the sensors point substantially perpendicular to the ground or to the surface on which the sensors are mounted. That is, the sensors are vertical.

Advantageously upward facing sensors detect obstacles above the operator.

In one embodiment the upward facing sensors are mounted on the control panel of the aerial lift.

In one embodiment the upward facing sensors are mounted on the back of the basket or cage.

Mounted on the control panel as employed herein means that they are fixed, typically temporarily, to an upper surface of the control panel such that they are operative in an upward facing direction.

In one embodiment there are two upward facing sensors mounted in front of the operator. For example, mounted on the control panel, such as within a control panel sensor housing.

In one embodiment there are two upward facing sensors mounted behind the operator.

All positions relative to the operator refer to the operator standing directly in front of and facing the control panel.

In one embodiment the upward facing sensors in front of the operator are located at a distance of approximately 500 to 600 mm from each other such as 510, 520, 530, 540, 550, 560, 570, 580 or 590 mm. For example approximately 550 mm from each other.

In one embodiment the upward facing sensors in front of the operator (that is, the bottom of the conical area) are positioned approximately 120 to 140 cm above the floor of the basket such as 121, 122, 123, 124, 125, 126, 127, 128, 129, 130, 131, 132, 133, 134, 135, 136, 137, 138 or 139 cm. For example approximately 130 cm (1300 mm) above the floor of the basket or cage.

In one embodiment the sensor housing is a control panel sensor housing.

Control panel sensor housing as employed herein means a housing for the sensor that is arranged and dimensioned to be attached to the control panel. Typically, the control panel sensor housing is attached to the protection bars surrounding the control panel. These bars are present to protect the control panel from collisions. Typically the control panel sensor housing does not increase the outer dimensions of the protection bar.

In one embodiment the control panel sensor housing is mounted on the control panel.

In one embodiment the control panel sensor housing does not protrude either into our out of the basket or cage.

Does not protrude either into or out of the basket or cage as employed herein means that it is dimensioned such that it is neither taller nor wider than the surface on which it is mounted. The housing is arranged to sit flush within its location. In the case of the control panel sensor housing this typically means that it is the same height and width as the protection bar on which it is attached. In the case of the sensor housing at the back of the cage this typically means that it is no deeper that the bars of the basket of cage on which it is mounted. Advantageously this means that the sensor housing is less likely to be struck in a collision. Further beneficially this means that the operator cannot injury themselves on the housing nor can they accidentally damage the housing by colliding with it.

In one embodiment the control panel sensor housing is approximately 620 to 660 mm long, such as 625, 630, 635, 640, 645, 650 or 655 mm long. For example approximately 641 mm long.

In one embodiment the control panel sensor housing houses two sensors. In one embodiment the sensors are upward facing sensors.

In one embodiment one or more sensors are rearward facing sensors.

Rearward facing as employed herein means that the sensors point substantially parallel to the ground or to the floor of the basket or cage. That is, they are horizontal.

Advantageously rearward facing sensors detect obstacles directly behind the operator.

In one embodiment the rearward facing sensors are mounted on the back of the basket or cage.

Back of the basket or cage as employed herein means the part of the basket or cage that is behind the operator when he stands in front of the controls for normal operation.

In one embodiment one or more sensors are angled-rearward facing sensors.

Angled-rearward as employed herein means the sensors point diagonally upward and rearward.

Advantageously angled-rearward facing sensors detect obstacle behind and above the operator.

In one embodiment the angled-rearward sensors are mounted on the back of the basket or cage.

In one embodiment two angled-rearward and one rearward sensor are housed in a sensor housing.

In one embodiment a sensor housing houses one rearward sensor having a detection range of approximately 400 mm wherein the sensor is substantially horizontal to the ground.

In one embodiment a sensor housing houses one angled-rearward sensor having a detection range of approximately 1000 mm wherein the sensor is angled inward by approximately 30 degrees relative to the vertical axis. Angled inward means pointing toward the entrance gate.

In one embodiment a sensor housing houses one angled-rearward sensor having a detection range of approximately 900 mm wherein the sensor is substantially vertical.

In one embodiment two sensor housings are mounted on the back of the basket or cage at a spaced apart location.

Spaced apart location as employed herein means that they are not proximal. In one embodiment the sensor housings are each mounted approximately 150 to 210 mm away from the entrance gate of the basket or cage. Such as approximately 150, 155, 160, 165, 170, 175, 180, 185, 190, 195, 200, 205 or 210 mm away from the entrance gate, for example approximately 180 mm from the entrance gate.

The distance away from the entrance gate is measured from the upright bar that forms the opening of the entrance gate to the nearest edge of the sensor housing as shown by in FIG. 6. The entrance gate is a standard size, generally 600 mm and therefore the edges of the two sensor housings are positioned approximately 960 mm apart.

Advantageously, it has been identified by the present inventors that sensor housings in a spaced apart location provide optimal protection for the operator.

Aerial lift baskets are typically a standard sized. In general there are two rails (the top rail and the mid rail) and a kick plate surrounding the perimeter of the basket. The top rail is typically approximately 1200 mm above the floor of the basket or cage, such as approximately 1126 mm from the floor to the underside of the top rail. The mid rail is typically positioned approximately 500 m below the top rail, such as 566 mm from the underside of the top rail to the top side of the mid rail. This provides a gap of approximately 566 mm that must be spanned by the sensor housing to be positioned securely in place.

In one embodiment the sensor housing including the arms is approximately 540 to 570 mm long, such as 541, 542, 543, 544, 545, 546, 547, 548, 549, 550, 551, 552, 553, 554, 555, 556, 557, 558, 559, 560, 561, 562, 563, 564, 565, 566, 567, 568 or 569 mm long. Such as approximately 566 mm long.

In one embodiment the sensor housing excluding the arms is independently approximately 140 to 160 mm long and approximately 140 to 160 mm high. Such as 141, 142, 143, 144, 145, 146, 147, 148, 149, 150, 151, 152, 153, 154, 155, 156, 157, 158 or 159 mm long and/or high. In one embodiment the sensor housing is approximately 150 mm by 150 mm.

In one embodiment the sensor housing comprises upper and/or lower arms and upper and lower clamps arranged to secure the housing to the basket or cage. Typically the upper clamp attaches to the top rail and the lower clamp attached to the mid rail.

In one embodiment the clamps are ergonomically designed.

Ergonomically designed as employed herein means that the profile of the clamps is smooth when positioned around the rail. Advantageously this means that the clamps do not protrude into the cage. Further beneficially the clamps do not have sharp edges.

In one embodiment the sensors do not detect the position of the operator inside the basket or cage. Advantageously, this permits the operator to undertake normal control of the basket or cage without triggering the sensors.

Removably attachable as employed herein means that the sensors can be attached to the aerial lift temporarily. Advantageously this means that the pre-crush sensor module can be fitted or removed from the lift as desired.

Detection zone as employed herein refers to the totality of all of the sensors sensing capacity. Typically the detection zone is arranged to detect obstacles that come within 1 meter above and behind the operator's head.

In one embodiment the operator is assumed to be 180 cm tall. In one embodiment the detection zone detects obstacles that are within 300 mm of the operator's head when standing in the basket. Therefore the detection zone is arranged to detect obstacles approximately 210 cm (2100 mm) above the bottom of the basket.

In one embodiment the sensors detect up to 80% of the detection zone.

Obstacle as employed herein means an object substantially large and solid enough to be detected by the sensors as a danger to the operator.

Strike as employed herein means to hit and potentially injure the operator.

Operator as employed herein means a man or woman standing in the basket or cage of the aerial lift, typically standing in front of the control panel.

Operator warning system as employed herein means a system designed to alert the operator of various factors, including but not limited to, an obstacle has entered the detection zone, the pre-crush sensor module is running in override mode, the pre-crush sensor module is faulty.

In one embodiment the warning system is a visual, audible or tactile warning system. For example, lights, sounds or vibrations.

In one embodiment the operator warning system comprises one or more warning lights.

Warning lights as employed herein means one or more lights that can show different states, for example different flash patterns or different colours.

In one embodiment the warning light is amber.

In one embodiment an amber warning light indicates that an obstacle has entered the detection zone.

In one embodiment the warning light is red.

In one embodiment a red warning light indicates that the pre-crush sensor is operating in override mode.

In one embodiment the warning light(s) are mounted on the control panel of the aerial lift.

In one embodiment the warning light(s) are mounted on the control panel sensor housing.

Relay to connect the sensors to the safety device as employed herein means a connection in communication with a safety device which is capable of transmitting a signal between the sensors and the safety device.

Activate the safety device as employed herein means that a signal is sent to the safety device to activate the safety device. Typically activation of the safety device will result in power being cut to the controls so that the basket or cage cannot be moved. In some circumstances an alarm may also be activated.

Alert the operator to the presence of the obstacle as employed herein means that a visual audible or tactile warning is transmitted to the operator to indicate that an obstacle has entered the detection zone.

Prevent movement as employed herein means that the basket or cage cannot be maneuvered. Typically this is due to the controls not receiving power either because the function enable switch is not activated or because the emergency switch has been activated.

In one embodiment the operator can override the pre-crush sensor module by activating an override procedure.

Override as employed herein means that the operator can choose to continue to work with an obstacle inside the detection zone. Advantageously this permits the operator to work on an obstacle if desired. For example, if the basket needs to be within a shorter distance to an obstacle than the pre-crush sensor module would allow before activating the safety device.

In one embodiment the override procedure comprises pressing an override button.

In one embodiment the override button is mounted on the control panel.

In one embodiment the override button is mounted on the control panel sensor housing.

In one embodiment the override procedure comprises depressing a foot switch.

In one embodiment the override is automatically reset into detection mode if the detection zone is clear of obstacles. That is, if an obstacle is detected and the operator overrides the pre-crush sensor module, then the operator moves out of the detection zone, the system is reset ready to detect the next obstacle.

In the context of this specification "comprising" is to be interpreted as "including".

Aspects of the disclosure comprising certain elements are also intended to extend to alternative embodiments "consisting" or "consisting essentially" of the relevant elements.

Where technically appropriate, embodiments of the invention may be combined.

Embodiments are described herein as comprising certain features/elements. The disclosure also extends to separate embodiments consisting or consisting essentially of said features/elements.

Technical references such as patents and applications are incorporated herein by reference.

Any embodiments specifically and explicitly recited herein may form the basis of a disclaimer either alone or in combination with one or more further embodiments.

The invention claimed is:

1. A pre-crush sensor module for use with a safety device for an aerial lift having a basket or cage, the pre-crush sensor module comprising:

a plurality of sensors that are removably attachable to the basket or cage, the sensors arranged to provide a detection zone wherein the sensors detect obstacles within the detection zone that may potentially strike an operator standing in the basket or cage before the strike occurs, said detection zone comprising an area above a head of said operator standing in the basket or cage, an operator warning system, and a relay to connect the sensors to the safety device to activate the safety device to:

alert the operator to the presence of the obstacle, and prevent further movement of the basket or cage, wherein said detection zone defined by said plurality of sensors is a Mohican shaped zone and a front side of said basket or cage is not within said detection zone, the front side adjacent a control panel of the aerial lift.

2. The pre-crush sensor module according to claim 1 wherein the sensors are ultrasonic sensors.

3. The pre-crush sensor module according to claim 1 wherein there are 8 sensors removably attachable to the basket or cage.

4. The pre-crush sensor module according to claim 3 wherein the 8 sensors are in the following positions:

two upward facing sensors are mounted on a control panel of the aerial lift, two rearward facing sensors are mounted on a back of the basket or cage, four angled-rearward facing sensors are mounted on the back of the basket or cage.

5. The pre-crush sensor module according to claim 4 wherein the two rearward facing sensors and four angled-rearward facing sensors are housed in two sensor housings such that there are one rearward facing sensor and two angled-rearward facing sensors in each sensor housing.

6. The pre-crush sensor module according to claim 5 wherein the sensor housings are mounted on the back of the basket or cage at a spaced-apart location.

7. The pre-crush sensor module according to claim 4 wherein the two upward facing sensors are housed in a control panel sensor housing.

8. The pre-crush sensor module according to claim 1 wherein each sensor is located such that it does not protrude either into or out of the basket or cage.

9. The pre-crush sensor module according to claim 1 wherein the detection zone extends approximately 210 cm above the floor of the basket or cage and approximately 100 cm behind the basket or cage.

10. The pre-crush sensor module according to claim 1 wherein the sensors do not detect the position of the operator inside the basket or cage.

11. The pre-crush sensor module according to claim 1 wherein the operator warning system comprises one or more warning lights mounted on the control panel of the aerial lift.

12. The pre-crush sensor module according to claim 1 wherein, when the sensors detect an obstacle and activate the safety device, the operator can override the pre-crush sensor module by activating an override procedure.

13. An aerial lift comprising a pre-crush sensor module according to claim 1.

14. A method of preventing an obstacle striking an operator standing in a basket or cage of an aerial lift comprising the steps:

installing a plurality of sensors to the basket or cage to establish a detection zone said detection zone comprising an area above a head of said operator standing in the basket or cage, connecting the sensors to a safety device capable of preventing movement of the basket or cage and/or alerting the operator to the presence of an obstacle, monitoring the detection zone for an obstacle entering the detection zone, sending a signal from the sensors to the safety device to instruct the safety device to alert the operator and/or to prevent movement of the basket or cage, wherein, in use, said detection zone established by said plurality of sensors is a Mohican shaped zone the sides of the basket or cage are not within said detection zone.

* * * * *